US005284677A

United States Patent [19]

Coughlin

[11] Patent Number: 5,284,677

[45] Date of Patent: Feb. 8, 1994

[54] COATED TEXTILE FOR APPAREL

[75] Inventor: Thomas E. Coughlin, Tyngsboro, Mass.

[73] Assignee: Worthen Industries, Inc., Nashua, N.H.

[21] Appl. No.: 968,040

[22] Filed: Oct. 27, 1992

[51] Int. Cl.[5] ..... B05D 3/12

[52] U.S. Cl. ..... 427/176; 427/173; 427/381; 427/382; 427/389.9

[58] Field of Search ..... 418/265, 267, 245, 296; 427/381, 382, 389.9, 173, 176

[56] References Cited

U.S. PATENT DOCUMENTS 4,684,568 8/1987 Lou ..... 428/265

*Primary Examiner*—James J. Bell

[57] ABSTRACT

A method for manufacturing a coated textile which exhibits a worn look when stressed. The method includes depositing a water-base resinous coating on the textile wherein the amount of coating placed on the textile is controlled such that the threads are coated but a thin film is not formed thereon. After depositing the coating on the material, the coating is passed through a first heat exchange zone to remove the water and dry the coating. Then the dried coated textile is passed through a second heat exchange zone wherein the temperature is sufficient to fuse the coating to the threads to obtain a clear coating such that when the textile is stressed the coating fractures importing a worn appearance to the stressed area of the textile.

4 Claims, 1 Drawing Sheet

FIG. 1
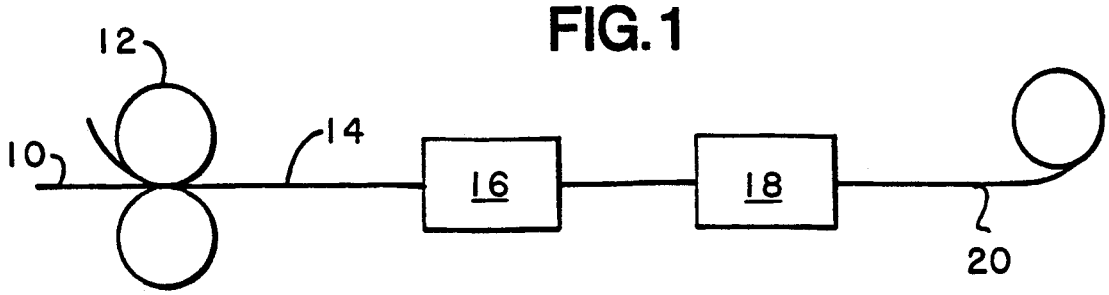
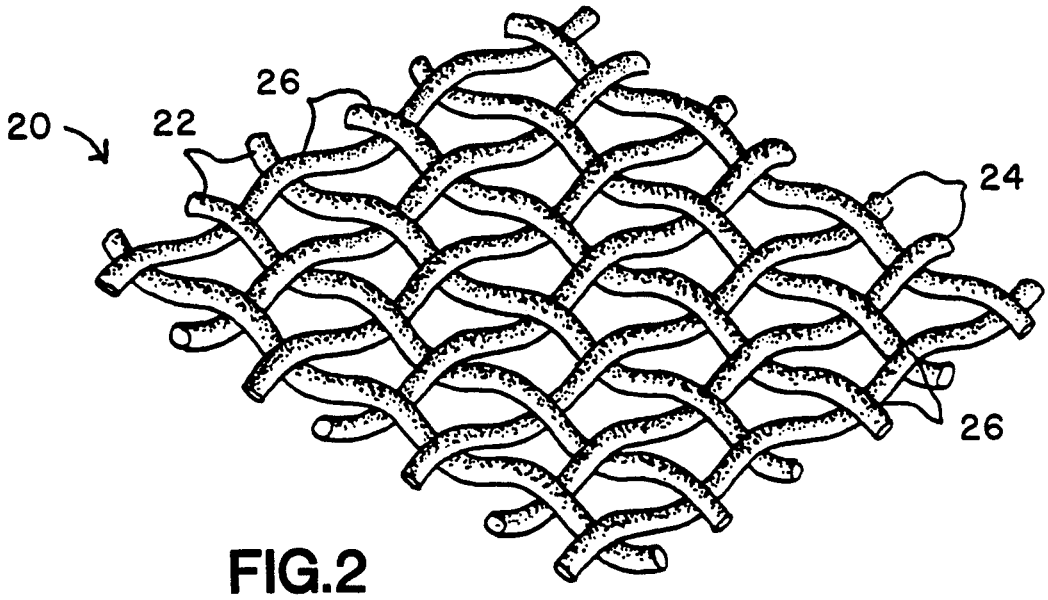
FIG. 2
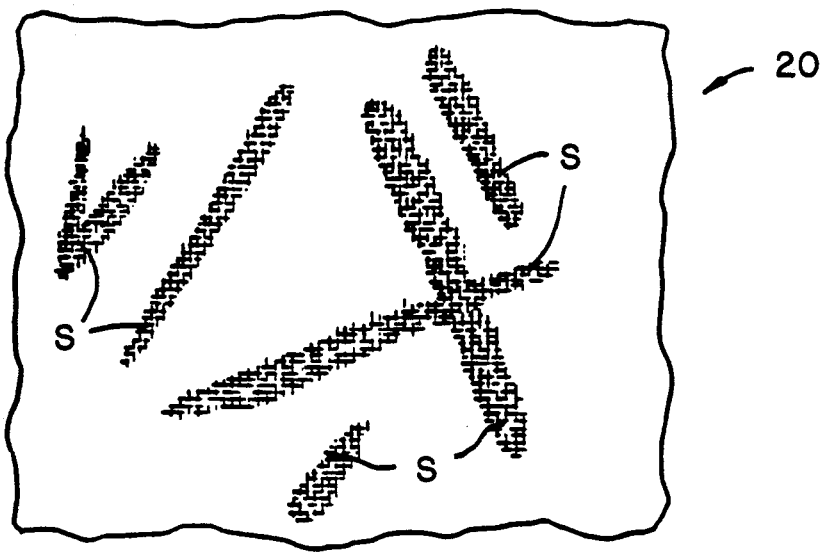
FIG. 3

COATED TEXTILE FOR APPAREL

FIELD OF THE INVENTION

This invention relates to a coated textile for apparel. When the surface is stressed the textile displays a worn and used look.

BACKGROUND AND BRIEF SUMMARY OF THE INVENTION

A current fashion is to use textiles for wearing apparel which textiles appear to have been already used, such as stone washed and acid washed denims.

Broadly the invention comprises a coated textile and a method of making the coated textile. The textile exhibits a worn look when stressed. The threads of the textile are coated with a clear fused resin. As used herein, 'clear' means free of cloudiness, haziness, muddiness or the like. Also, the fused resin is colorless when viewed by the human eye. Although, for some applications color or tint can be desirable. The fused resin does alter slightly the refractive index of the textile and in some fabrics can result in a slightly darker color. Preferred textiles are those designed for outdoor apparel, footwear, luggage and accessories.

The resin is applied to the textile such that the threads do not loose their definition. That is, the individual threads are coated but a thin uniform continuous film is not formed on the textile. When the fused resin is stressed, such as by creasing, crushing or abrading the textile by hand or machine, the fused resin internally fractures, changing its optical characteristics such that it's appearance changes from clear to opaque. As used herein, 'opaque' means the stressed resin imparts a stone-washed or worn look to the fabric as those terms are understood in the art. Depending upon the ultimate look that is desired by the apparel manufacturer, the locations of the stressed areas and the degree of stress applied, i.e. slightly to very worn will vary. The textiles treated are commercially available, nylons, polyesters, cotton polyester blends. Surprisingly, the application of the coating does not affect the wear resistance, moisture vapor transmission, water repellency or flexibility (hand) of the fabric.

BRIEF DESCRIPTIONS OF THE DRAWINGS

FIG. 1 is a flow diagram of the process of the invention.

FIG. 2 is a perspective view of a coated textile of the invention; and

FIG. 3 is a plan view of a coated textile after stressing.

DESCRIPTION OF THE PREFERRED EMBODIMENT(S)

Example

The following is a non-limiting example of a method and the coated textile(s) of the invention.

A water-based low density polyethylene resin emulsion (SL 300-Daniel Products Co.) containing a glycol was mixed with a thickener (Rohm & Haas RM 825) to increase the viscosity of the emulsion. The emulsion had a viscosity of 700–800 cps when mixed with the thickener at a ratio of 100 wet pounds of SL 300 to 25 wet pounds of RM 825 thickener.

Referring to FIG. 1, the formulated resin emulsion was evenly applied across a web of nylon cordural textile 10, S/WR-1000 Denier Cordura, by a knife over roll applicator 12 which was adjusted to give a knife gap of 0.005 inches to form a coated textile 14.

The coated textile 14 was then passed through a drying zone 16 at 230° F. for 15–25 seconds to evaporate the water content. The textile 14 then continued into a second drying zone 18 where the coating was fused at a temperature of 350° F. for a period of approximately 20 seconds to form a coated textile 20.

The final coat weight was between 1.0 and 1.5 oz/sq yard dry. The fused finish dried perfectly clear and contained no coloring matter.

The coatings, however, impart a slightly different index of refraction to the coated side of the textile. Thus, some light colored textiles appeared slightly darker after they had been coated and fused. The resin was fused on the individual threads.

Referring to FIG. 2, the fused textile 20 of the present invention comprises warp and weft threads 22 and 24 which have the resin 26 fused thereon. The fused resin coats the individual threads but does not form a uniform film on the textile.

The fused coated textile is manipulated by brisk rubbing by hand or flexing to create stress-flex marks in an irregular pattern on the fabric. This step is generally performed by the apparel manufacturer. Depending upon the amount of rubbing or flexing the "used" look can be varied. Also, the irregular pattern may be varied by only coating certain areas of the piece of textile, so that only those pre-selected areas may be manipulated to produce an irregular pattern. FIG. 3 illustrates the textile 20 with areas S having been stressed to show a worn look, the resin in the areas S being opaque and not clear.

Other textiles suitable for purposes of the invention include other nylons, polypropylenes, polyesters and polycottons. These textiles are well known in the art.

Although described in reference to a specific low density (0.910–0.925 gm/cm$^3$) polyethylene resin emulsion in a specific ratio with a thickener, other resins, such as medium density polyethylene (0.926–0.940 gm/cm$^3$), are also believed suitable. These resins exhibit substantially similar characteristics such as fusing clear in temperature range of 250° F. to 350° F., coating weights between 1.0 to 1.5 oz/yd$^2$, application viscosity between 700 cps to 800 cps, and transition to opaque when stressed. Although the stressing can be by machine, such as rollers, hand pressure is sufficient, typically 10 to 25 psi. Also, an important property is the fused coating does not deleteriously affect the properties of the textile which is coated. The amount of thickener added, i.e. the amount of solids, is selected to ensure that the viscosity is low enough to coat the threads but not form a film. Other thickeners can be used and include HENKEL/DSX-1550.

Surprisingly, the resin coated textiles maintain the same approximate slip value or coefficient of friction, the same 'hand', the same good low temperature flexibility, high moisture vapor transmission and water repellancy, which also increases the users, comfort, as the uncoated base fabric taken alone and therefore remain dry and non-sticky. However, the finish has impact strength to resist wear and chipping.

The foregoing description has been limited to a specific embodiment of the invention. It will be apparent, however, that variations and modifications can be made to the invention, with the attainment of some or all of the advantages. Therefore, it is the object of the claims to cover all such variations and modifications as come within the true spirit and scope of the invention.

Having described my invention, what I now claim is:

1. A method of manufacturing a coated textile, the coating exhibiting a worn look when stressed comprising:

depositing a water-based resinous coating on said textile;

controlling the amount of coating on said textile such that the threads are coated but a thin film is not formed;

passing the coated textile through a first heat exchange zone to remove the water and dry the coating; and passing the dry coated textile through a second heat exchange zone, the zone at a temperature sufficient to fuse the coating to said threads to obtain a clear coating on the threads whereby when said textile is stressed the coating fractures, importing a worn appearance to the stressed area of the textile.

2. The method of claim 1, wherein said fabric is selected from the group consisting essentially of nylons, polyester and poly-cotton fabrics.

3. The method of claim 1, wherein said resin is selected from the group consisting essentially of low and medium density polyethylene.

4. The method of claim 1, wherein said coating is fused on said fabric at a temperature of between 250° F. to 350° F.

* * * * *